US005927266A

United States Patent [19]

Maugard

[11] Patent Number: 5,927,266

[45] Date of Patent: Jul. 27, 1999

[54] DISPOSABLE OVEN LINER

[75] Inventor: Pierre Maugard, Ft. Lauderdale, Fla.

[73] Assignee: Pierre Maugard, Ft. Lauderdale, Fla.

[21] Appl. No.: 08/867,572

[22] Filed: Jun. 2, 1997

[51] Int. Cl.[6] ..... F24C 3/00

[52] U.S. Cl. ..... 126/39 M; 126/9 B; 126/26; 219/10.55 E; 219/10.55 R; 219/392

[58] Field of Search ..... 126/39 M, 26, 126/9 B; 219/392, 10.55 E, 10.55 R

[56] References Cited

U.S. PATENT DOCUMENTS

| | | | |
|---|---|---|---|
| 1,704,175 | 3/1929 | Coale . | |
| 3,368,732 | 2/1968 | Kimble . | |
| 3,994,275 | 11/1976 | Williams | 126/141 |
| 4,535,753 | 8/1985 | Zayauskas | 126/274 |
| 4,633,052 | 12/1986 | Beavers et al. | 219/10.55 E |
| 4,667,078 | 5/1987 | Sakurai | 219/10.55 |
| 4,778,968 | 10/1988 | Torres | 219/10.55 E |
| 5,423,309 | 6/1995 | Miller | 126/260 |

*Primary Examiner*—Larry Jones

[57] ABSTRACT

The present invention is a disposable device which is placed inside an oven to improve the cooking properties and contain splatter from food products. The interior surface of the cube is heat reflective material. Venturi holes are critically placed to circulate air flow and to improve the cooking characteristics and browning of food products.

14 Claims, 2 Drawing Sheets

DISPOSABLE OVEN LINER

BACKGROUND OF THE INVENTION

1. Field of the Invention

The present invention relates to cooking oven liners. More particularly, the present invention relates to disposable cooking oven liners which enhance the cooking of food.

2. Description of the Prior Art

Numerous innovations for a disposable oven liner have been provided in the prior art that are described as follows. Even though these innovations may be suitable for the specific individual purposes to which they address, they differ from the present invention as hereinafter contrasted.

In U.S. Pat. No. 5,423,309, titled, Oven Attachment for a Camping Lantern, invented by Rockford M. Miller, Sr and Timoth S. Mannen, an oven attachment is provided for a camping lantern, in which the oven attachment is configured to be attached to the lantern so as to form an integral component of the lantern. In particular, the oven attachment provides an enclosure in which foods and beverage containers can be placed and uniformly heated with the heat generated by a conventional camping lantern. The versatility of the oven attachment is enhanced by the ability to regulate the temperature of the enclosure with a damper assembly. Yet the oven attachment is constructed such that its use and structure does not interfere with the safe operation of the lantern as intended by the manufacturer, nor does the oven attachment significantly diminish the lighting capability of the lantern.

The patented invention differs from the present invention because the patented invention is an oven attachment specifically adapted to function in cooperation with a camping lantern. The heat from the lantern provides the cooking heat. The present invention is inserted into existing ovens functioning to improve the cooking characteristics and browning of food products.

In U.S. Pat. No. 4,667,075, titled Microwave Oven for Vehicles, invented by Takashi Sakurai, a microwave oven for a camping or other vehicle includes a heating room in which an object is heating by applying microwaves thereto, a microwave guide to propagate the microwaves into the heating room, a magnetron to produce the microwave for the microwave guide, and a voltage supply device to supply the magnetron with an appropriate voltage. The voltage supply device includes a transformer to boost the three-phase AC voltage from an alternator mounted on the vehicle, and a rectifying circuit to rectify the three-phase AC voltage boosted by the transformer. The magnetron receives the voltage rectified. The heater terminal and other main terminal of the magnetron are connected to terminals of the battery mounted on the vehicle.

The patented invention differs from the present invention because the patented invention is a microwave oven for a camping or other vehicle. The patented invention is not similar to present invention.

In U.S. Pat. No. 4,535,753, titled Radiant Heat Collector, invented by Leo Zayauskas, a radiant heat collector is disclosed in the form of a reflector oven. The oven collects heat from a heat source adjacent to the oven. The reflective surfaces are detachably secured to end plates, which plates are of a generally rectangular configuration. Tie rods may be used to retain the grill assembly, or tabs on either the grill or on the reflective surfaces, or on both, and may be used for this purpose with or without tie rods. The assembled reflector is of a generally elliptical section shape (rather than parabolic) to enhance the thorough heating of the material placed on the grill to be heated. The elliptical section encompasses one end of an ellipse about one focus line and a source of heat may be conveniently located at the other focus line. The major axis of the ellipse dips downward from the section to the heat source and the rack or grill is positioned under the section focus line essentially to one side of the major axis. The source of heat for the grill is generally an external source, such as a fire, positioned in front of and fairly close to the oven at the elliptical external focus line. The oven is readily assembled or disassembled to form a compact package and may be used indoors with a fireplace, for example, or outdoors when camping or picnicking.

The patented invention differs from the present invention because the patented invention is an oven which collects heat from a heat source adjacent to the oven such as an open fire. The patented invention has reflective focused surfaces for the purpose of reflecting heat toward the food product to be cooked. The patented invention is not designed to function on top of a stove burner. The present invention is a device which is placed inside an oven to improve the cooking properties and contain splatter from food products. The interior surface of the cube is heat reflective material. Venturi holes are critically placed to circulate air flow to improve the cooking characteristics and browning of food products.

The above patented inventions differ from the present invention because they fail to describe or claim at least one combination of the following features depicted in the present invention including an oven insert, having a cube like shape with a top opening cover, which is placed in an oven. The prior art inventions further, lack an interior surface of heat reflective material. Critically placed venturi holes function to circulate air flow and to improve the cooking characteristics of the oven.

Numerous innovations for disposable oven liner have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a disposable device which is placed inside an oven to improve the cooking properties and contain splatter from food products. The interior surface of the cube is heat reflective material. Venturi holes are critically placed to circulate air flow and to improve the cooking characteristics and browning of food products.

The types of problems encountered in the prior art are that cooking foods splatter the inside of an oven. Further, the location of the heating elements inside of an oven are cause uneven cooking.

In the prior art, unsuccessful attempts to solve this problem were attempted namely: devices using a remote heat source such as a campfire, lantern, and microwaves. Each attempted solution locates the device away from the heat source and does not adapt to an oven. Other attempts at a disposable splatter shielding were limited to the bottom portion of the oven. However, the problem was solved by the present invention because the present invention is inserted into an oven and encompasses the food products keeping splatters from reaching the oven walls. Further, the present invention enhances the cooking of food products by providing a more uniform distribution of heat throughout the food interior and surface.

The present invention solved a long felt need for a total interior splatter shield that collects splatters on the side, back, front, and top as well as the bottom.

Accordingly, it is an object of the present invention to provide a disposable splatter shield which protects the six interior sides of an oven.

More particularly, it is an object of the present invention to provide a disposable splatter shield which is stored in a compact folded condition, is deployed inside an oven and has apertures which enhance convection providing a more uniform heat distribution surrounding the food product.

In keeping with these objects, and with others which will become apparent hereinafter, one feature of the present invention resides, briefly stated, in a disposable heat reflective material which is folded from a flat state by the user to fit the interior of an oven.

In accordance with another feature of the present invention, a front is secured to each side by tabs.

Another feature of the present invention is that a front aperture is baffled by a reflective flap which extends interiorly downward from the top of the front.

Yet another feature of the present invention is that a front aperture provides an inlet for heated air from the heating elements.

Still another feature of the present invention is that a top cover extend forward from the rear providing a top splatter shield and reflects heat downwardly.

Yet still another feature of the present invention is that vent apertures are provided between the top cover and the sides permitting air to exhaust. The escaping air draws replacement air through lower apertures thus circulating air carrying heat throughout the interior of the present invention. This promotes more even heat distribution, resulting in even cooking and browning.

Still yet another feature of the present invention is that the aperture openings are adjustable.

Another feature of the present invention is that the patented invention is made in various sizes.

Yet another feature of the present invention is that is manufactured from flat material Still another feature of the present invention is that the present invention folds to a small size for transportation and storage.

Yet still another feature of the present invention is that when folded into a deployed shape, tabs located on the fold upwardly forming a drip pan.

Still yet another feature of the present invention is that juices from the food product splattered on the sides and top of the interior, of the present invention, collect, then drip onto the food product resulting in a self basting process occurring.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERNCE NUMERALS UTILIZED IN THE DRAWINGS

10—disposable oven liner(10)
12F—front panel (12F)
12FA—first front panel (12FA)
12FAA—first front panel opening (12FAA)
12FAR—first front panel right slot (12FAR)
12FAL—first front panel left slot (12FAL)
12FB—second front panel (12FB)
12FCA—first front panel first crease (12FCA)
12FCB—first front panel second crease (12FCB)
12FDR—front panel right lower tab (12FDR)
12FDL—front panel left lower tab (12FDL)
12BA—back panel (12BA)
12BAA—back panel flap (12BAA)
12BAR—back panel right slot (12BAR)
12BAL—back panel left slot (12BAL)
12BCA—back panel first crease (12BCA)
12BCB—back panel second crease (12BCB)
12BCC—back panel fold (12BCC)
12BDR—back panel right lower tab (12BDR)
12BDL—back panel left lower tab (12BDL)
12BB—top panel (12BB)
12L—left panel (12L)
12LF—left panel front upper tab (12LF)
12LB—left panel back upper tab (12LB)
12LC—left panel crease (12LC)
12LBR—left panel back lower tab (12LBR)
12LBL—left panel front lower tab (12LBL)
12LDF—left panel front flap (12LDF)
12LDB—left panel back flap (12LDB)
12R—right panel (12R)
12RF—right panel front upper tab (12RF)
12RB—right panel back upper tab (12RB)
12RC—right panel crease (12RC)
12RBR—right panel back lower tab (12RBR)
12RBL—right panel front lower tab (12RBL)
12RDF—right panel front flap (12RDF)
12RDB—right panel back flap (12RDB)
12C—bottom panel (12C)

DESCRIPTION OF THE PREFERRED EMBODIMENT

Figure 1:
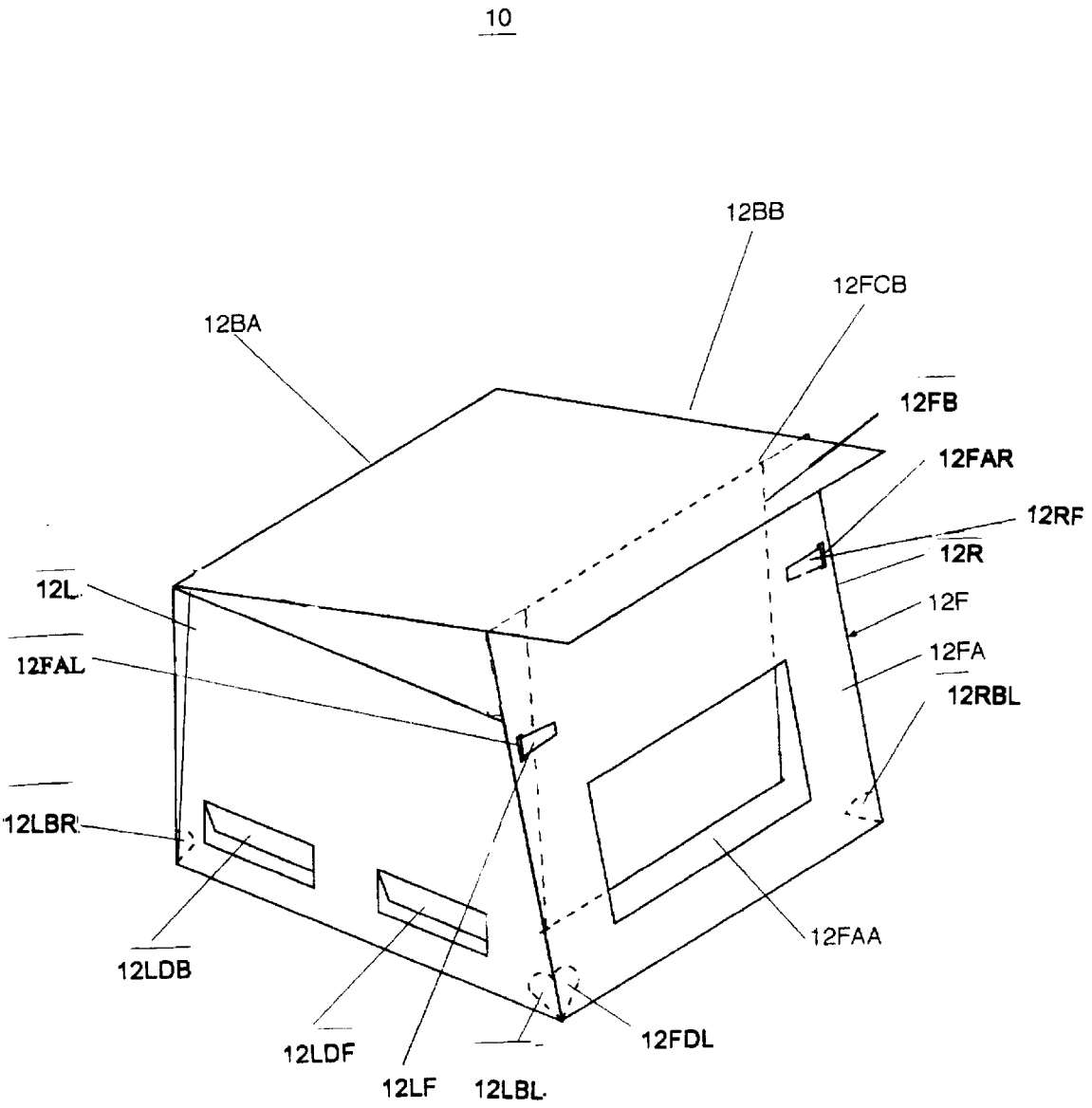
FIG. 1 is a perspective view of a deployed disposable oven liner.
Figure 2:
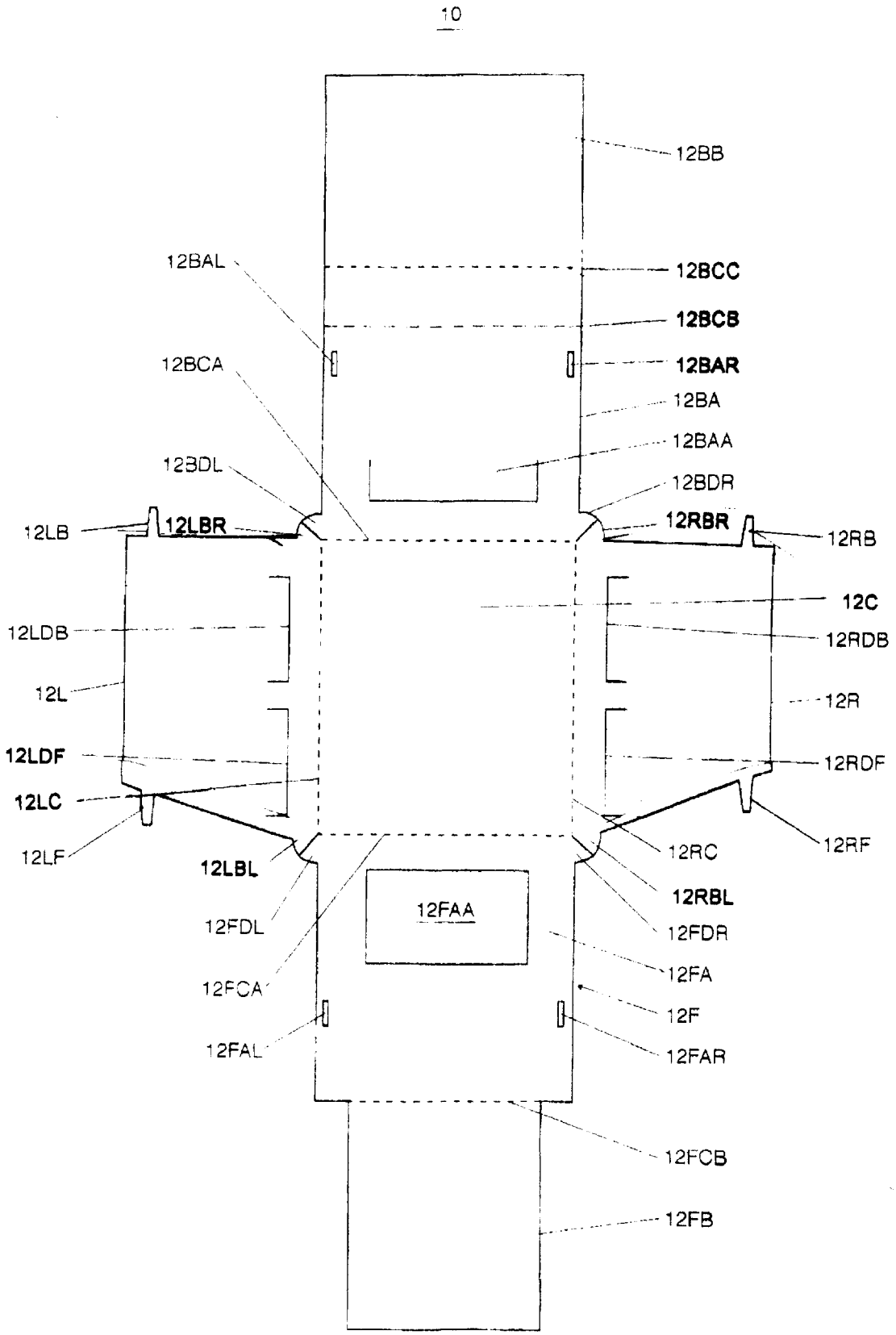
FIG. 2 is a top view of a unassembled disposable oven liner.

Firstly, referring to FIG. 1 and FIG. 2 which is a perspective view and a top view of a unassembled disposable oven liner (10) respectively comprising a front panel (12F). The front panel (12F) comprises a first front panel (12FA) and a second front panel (12FB). The first front panel (12FA) comprises four sides at perpendicular angles to each other. The second front panel (12FB) comprises four sides at perpendicular angles to each other. The second front panel (12FB) further comprises a width and height slightly less than a width of the first front panel (12FA). The first front panel (12FA) is attached to the second front panel (12FB) having a first front panel second crease (12FCB) therebetween. The first front panel (12FA) further comprises at least one first front panel right slot (12FAR) therein. The first front panel (12FA) further comprises at least one first front panel left slot (12FAL) therein. The first front panel (12FA) further comprises a first front panel opening (12FAA) therein. A bottom edge of the front panel (12F) is attached along a front edge of a bottom panel (12C) having a first front panel first crease (12FCA) therebetween.

The disposable oven liner (10) further comprises a back panel (12BA), The back panel (12BA) comprises four sides at perpendicular angles to each other. The top panel (12BB) further comprises a larger height to a height of the back panel (12BA). The back panel (12BA) is attached to the top panel (12BB) having a back panel second crease (12BCB) therebetween. The top panel (12BB) further comprises a back panel fold (12BCC) therein. The back panel (12BA) further comprises at least one back panel right slot (12BAR) therein. The back panel (12BA) further comprises at least one back panel left slot (12BAL) therein. The back panel (12BA) further comprises at least one back panel left slot (12BAL) therein. A bottom edge of the back panel (12BA) is attached along a back edge of a bottom panel (12C) having a back panel first crease (12BCA) therebetween The disposable oven liner (10) still further comprises a left panel (12L) which comprises a three sides having perpendicular angles therebetween and one side having an acute angle from a front of a left edge of the bottom panel (12C). The left panel (12L) further comprises at least one left panel front upper tab (12LF). The left panel (12L) further comprises at least one left panel back upper tab (12LB), at bottom edge of the left panel (12L) is attached along the left edge of the bottom panel (12C) having a left panel crease (12LC) therebetween.

The disposable oven liner (10) still further comprises a right panel (12R) which comprises a three sides having perpendicular angles therebetween. One side of the right panel (12R) having an acute angle from a front of a right edge of the bottom panel (12C). The right panel (12R) comprises at least one right panel front upper tab (12RF). The right panel (12R) still further comprises at least one right panel back upper tab (12RB), at the bottom edge of the right panel (12R), which is attached along the right edge of the bottom panel (12C) having a right panel crease (12RC) therebetween. An user, firstly, folds the front panel (12F) along the first front panel first crease (12FCA) in an upward direction. The user secondly folds the left panel (12L) in an upward direction along the left panel crease (12LC) inserting the at least one left panel front upper tab (12LF) through the at least one first front panel left slot (12FAL) and folding over. The user thirdly folds the right panel (12R) in an upward direction along the right panel crease (12RC) inserting the at least one right panel front upper tab (12RF) through the at least one first front panel right slot (12FAR) and folding over. The user fourthly folds the back panel (12BA) in an upward direction along the back panel first crease (12BCA) inserting the at least one left panel back upper tab (12LB) through the at least one back panel left slot (12BAL) and folding over and further inserting the at least one right panel back upper tab (12RB) through the at least one back panel right slot (12BAR) and folding over. The user fifthly folds the second front panel (12FB) downwardly into the disposable oven liner(10) along the first front panel second crease (12FCB). After placing food therein, the user sixthly folds the top panel (12BB) along the back panel second crease (12BCB) downwardly and thereafter folds a front end of the top panel (12BB) in an upward direction along a back panel fold (12BCC) to cover the disposable oven liner(10) which is then placed in an oven for cooking the food contained therein.

The right panel (12R) further comprises a right panel back lower tab (12RBR) and a right panel front lower tab (12RBL). The first front panel (12FA) further comprises a front panel right lower tab (12FDR) and a front panel left lower tab (12FDL). The back panel (12BA) further comprises a back panel right lower tab (12BDR) and a back panel left lower tab (12BDL). The left panel (12L) further comprises a left panel back lower tab (12LBR) and a left panel front lower tab (12LBL). Folding the right panel (12R), first front panel (12FA), back panel (12BA), and left panel (12L) causes the right panel back lower tab (12RBR), right panel front lower tab (12RBL), front panel right lower tab (12FDR), front panel left lower tab (12FDL), back panel right lower tab (12BDR), back panel left lower tab (12BDL), left panel back lower tab (12LBR) and left panel front lower tab (12LBL) to fold upwardly forming a corner which functions to prevent cooking juices collecting on the bottom panel (12C) from dripping to the oven floor.

The back panel (12BA) further comprises a back panel flap (12BAA) therein. The back panel flap (12BAA) is adjustable and permits air to enter the disposable oven liner (10).

The left panel (12L) further comprises at least one left panel front flap (12LDF) and a left panel back flap (12LDB). The at least one left panel front flap (12LDF) and a left panel back flap (12LDB) are adjustable and permit air to enter the disposable oven liner (10).

The right panel (12R) further comprises at least one right panel front flap (12RDF) and a right panel back flap (12RDB). The at least one right panel front flap (12RDF) and a right panel back flap (12RDB) are adjustable and permit air to enter the disposable oven liner (10).

The height of first front panel (12FA) and the height of the second front panel (12FB) are greater than a height of the left panel (12L) and the right panel (12R) functioning to provide space allowing heat to escape when the top panel (12BB) covers the disposable oven liner(10).

The disposable oven liner(10) is manufactured from a material consisting of metal, and metal alloy, or any suitable material.

It will be understood that each of the elements described above, or two or more together, may also find a useful application in other types of constructions differing from the type described above.

While the invention has been illustrated and described as embodied in a disposable oven liner, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A disposable oven liner(10) comprising:

A) a front panel (12F) which comprises a first front panel (12FA) and a second front panel (12FB), the first front panel (12FA) comprises four sides at perpendicular angles to each other, the second front panel (12FB) comprises four sides at perpendicular angles to each other, the second front panel (12FB) further comprises a width and height slightly less than a width of the first front panel (12FA), the first front panel (12FA) is attached to the second front panel (12FB) having a first front panel second crease (12FCB) therebetween, the first front panel (12FA) further comprises at least one first front panel right slot (12FAR) therein, the first front panel (12FA) further comprises at least one first front panel left slot (12FAL) therein, a bottom edge of the front panel (12F) is attached along a front edge of a bottom panel (12C) having a first front panel first crease (12FCA) therebetween;

B) a back panel (12BA) and a top panel (12BB), the back panel (12BA) comprises four sides at perpendicular angles to each other, the top panel (12BB) comprises four sides at perpendicular angles to each other, the top panel (12BB) further comprises a similar width to a width of the back panel (12BA), the top panel (12BB) further comprises a larger height to a height of the back panel (12BA), the back panel (12BA) is attached to the top panel (12BB) having a back panel second crease (12BCB) therebetween, the top panel (12BB) further comprises a back panel fold (12BCC) therein, the back panel (12BA) further comprises at least one back panel right slot (12BAR) therein, the back panel (12BA) further comprises at least one back panel left slot (12BAL) therein, the back panel (12BA) further comprises at least one back panel left slot (12BAL) therein;

C) a left panel (12L) which comprises a three sides having perpendicular angles therebetween and one side having an acute angle from a front of a left edge of the bottom panel (12C), the left panel (12L) further comprises at least one left panel front upper tab (12LF), the left panel (12L) further comprises at least one left panel back upper tab (12LB), at bottom edge of the left panel (12L) is attached along the left edge of the bottom panel (12C) having a left panel crease (12LC) therebetween; and D) a right panel (12R) which comprises a three sides having perpendicular angles therebetween and one side having an acute angle from a front of a right edge of the bottom panel (12C), the right panel (12R) further comprises at least one fight panel front upper tab (12RF), the right panel (12R) further comprises at least one right panel back upper tab (12RB), at bottom edge of the right panel (12R) is attached along the right edge of the bottom panel (12C) having a right panel crease (12RC) therebetween, an user firstly folds the front panel (12F) along the first front panel first crease (12FCA) in an upward direction, the user secondly folds the left panel (12L) in an upward direction along the left panel crease (12LC) inserting the at least one left panel front upper tab (12LF) through the at least one first front panel left slot (12FAL) and folding over, the user thirdly folds the right panel (12R) in an upward direction along the right panel crease (12RC) inserting the at least one right panel front upper tab (12RF) through the at least one first front panel right slot (12FAR) and folding over, the user fourthly folds the back panel (12BA) in an upward direction along the back panel first crease (12BCA) inserting the at least one left panel back upper tab (12LB) through the at least one back panel left slot (12BAL) and folding over and further inserting the at least one right panel back upper tab (12RB) through the at least one back panel right slot (12BAR) and folding over, the user fifthly folds the second front panel (12FB) downwardly into the disposable oven liner(10) along the first front panel second crease (12FCB), after placing food therein, the user sixthly folds the top panel (12BB) along the back panel second crease (12BCB) downwardly and thereafter folds a front end of the top panel (12BB) in an upward direction along a back panel fold (12BCC) to cover the disposable oven liner(10) which is then placed in an oven for cooking the food contained therein.

2. The disposable oven liner(10) as described in claim 1, wherein the first front panel (12FA) further comprises a first front panel opening (12FAA) therein.

3. The disposable oven liner(10) as described in claim 1, wherein the first front panel (12FA) further comprises a front panel right lower tab (12FDR) and a front panel left lower tab (12FDL).

4. The disposable oven liner(10) as described in claim 1, wherein the back panel (12BA) further comprises aback panel flap (12BAA) therein.

5. The disposable oven liner(10) as described in claim 1, wherein the back panel (12BA) further comprises a back panel right lower tab (12BDR) and a back panel left lower tab (12BDL).

6. The disposable oven liner(10) as described in claim 1, wherein the left panel (12L) further comprises a left panel back lower tab (12LBR) and a left panel front lower tab (12LBL).

7. The disposable oven liner(10) as described in claim 1, wherein the left panel (12L) further comprises at least one left panel flap.

8. The disposable oven liner(10) as described in claim 7, wherein the at least one left panel flap is a left panel front flap (12LDF) and a left panel back flap (12LDB).

9. The disposable oven liner(10) as described in claim 1, wherein the right panel (12R) further comprises a right panel back lower tab (12RBR) and a right panel front lower tab (12RBL).

10. The disposable oven liner(10) as described in claim 1, wherein the right panel (12R) further comprises at least right panel flap.

11. The disposable oven liner(10) as described in claim 10, wherein the at least right panel flap comprises a right panel front flap (12RDF) and a right panel back flap (12RDB).

12. The disposable oven liner(10) as described in claim 1, wherein the height of first front panel (12FA) and the height of the second front panel (12FB) are greater than a height of the left panel (12L) and the right panel (12R) functioning to provide space allowing heat to escape when the top panel (12BB) covers the disposable oven liner(10).

13. The disposable oven liner(10) as described in claim 1 is manufactured from a material consisting of metal, metal alloy, or any suitable material.

14. The disposable oven liner(10) as described in claim 13 is manufactured from aluminum.

* * * * *